United States Patent [19]

Narasimhan, Jr. et al.

[11] 4,372,753

[45] Feb. 8, 1983

[54] LIQUID FUEL FOR USE IN INTERNAL COMBUSTION ENGINES

[75] Inventors: Mandayam J. Narasimhan, Jr.; Mandayam J. Thirmulachar, both of Walnut Creek, Calif.

[73] Assignee: Source Technology, Inc., Minneapolis, Minn.

[21] Appl. No.: 143,031

[22] Filed: Apr. 23, 1980

[51] Int. Cl.[3] ..... C10L 1/18

[52] U.S. Cl. ..... 44/52; 44/77

[58] Field of Search ..... 44/52, 77

[56] References Cited

U.S. PATENT DOCUMENTS

| | | | |
|---|---|---|---|
| 1,331,054 | 2/1920 | Dinsmore | 44/77 |
| 1,398,948 | 11/1921 | Schreiber | 44/77 |
| 1,399,227 | 6/1921 | Bohrs | 44/77 |
| 1,423,049 | 7/1922 | Tunison | 44/77 |
| 1,425,136 | 8/1922 | Bohrs | 44/77 |
| 1,438,823 | 12/1922 | Gray | 44/77 |
| 1,460,767 | 7/1923 | Bohrs | 44/77 |
| 1,557,257 | 10/1925 | La Riboisiert | 44/77 |
| 1,597,343 | 8/1926 | Chandler | 44/77 |
| 1,622,572 | 3/1927 | Chandler | 44/77 |
| 1,665,621 | 4/1928 | Chandler | 44/77 |
| 2,100,287 | 11/1937 | Conquest | 44/77 |
| 2,106,661 | 1/1938 | Savage | 44/77 |
| 2,165,261 | 7/1939 | Hewlett et al. | 44/77 |
| 2,176,747 | 10/1939 | Schneider et al. | 44/77 |
| 2,210,942 | 8/1940 | Lipkin | 44/77 |
| 2,225,942 | 12/1940 | Schneider et al. | 44/77 |
| 2,316,754 | 4/1943 | Backoff et al. | 44/77 |
| 2,350,145 | 5/1944 | Backoff et al. | 44/58 |
| 2,398,197 | 4/1946 | Stanly | 44/74 |
| 2,407,718 | 9/1946 | Marschner et al. | 44/77 |
| 2,643,942 | 6/1953 | Barusch | 44/56 |
| 3,224,848 | 12/1965 | Henderson | 44/56 |

FOREIGN PATENT DOCUMENTS

| | | | |
|---|---|---|---|
| 7793 | of 1904 | United Kingdom | 44/52 |
| 107217 | 6/1917 | United Kingdom | 44/52 |

*Primary Examiner*—J. V. Howard

*Attorney, Agent, or Firm*—Merchant, Gould, Smith, Edell, Welter & Schmidt

[57] ABSTRACT

A fuel is provided including dimethyl ketone and gasoline. Gaseous fuel such as methane and acetylene may be dissolved in the ketone-gasoline combination.

12 Claims, No Drawings

LIQUID FUEL FOR USE IN INTERNAL COMBUSTION ENGINES

BACKGROUND OF THE INVENTION

The present invention relates to fuel suitable for internal combustion engines and more particularly relates to a partially synthetic fuel which includes gasoline and which may be used in an automobile engine with minimal resultant pollution.

In recent years, much more effort has been expended in attempting to develop pollution free automobiles and more efficient engines. This has been prompted by the limited supply and increased cost of gasoline derived from petroleum. Effort has also been made to develop suitable synthetic fuels for the automobile. Perhaps, the most recognized synthetic fuel at the present time is the commonly called gasohol. Gasohol is a mixture of gasoline and ethyl alcohol.

In developing new fuels for automobiles, it is highly desirable that the fuels have characteristics similar to conventional gasoline whereby the fuel can be used without major modification of the automobile engine. For example, the new fuel should have combustion characteristics similar to present day gasoline.

The present invention in its most specific applications, provides a new fuel which may have dimethyl ketone, more commonly called acetone (and which may include a sequential, generic, lower numbered hydrocarbon base), as a major component and conventional gasoline as a minor component. The dimethyl ketone may originate from coal, natural gas or petroleum sources and may be obtained from other sources (e.g. the dry distillation of calcium acetate or microbial fermentation).

Dimethyl ketone has been taught for use at low levels in motor fuels. For example, U.S. Pat. No. 2,106,661 (Savage) teaches use of a composition including eight parts acetone and one part naphthalene by volume but at a level of not over one percent or less than one twenty-fifth of one percent of the petroleum motor fuel. Savage further teaches that tetra ethyl lead is added to the petroleum fuel. U.S. Pat. No. 1,438,823 (Gray) shows a combination of commercial kerosene and acetone for use as fuel for an internal combustion engine. The acetone is described as being present in an amount of 0.5%. Gray states that the kerosene-acetone mixture may be impregnated with a gaseous hydrocarbon of the paraffin series such as methane.

GENERAL DISCUSSION OF THE PRESENT INVENTION

In its broader scope the invention relates to new, partially synethetic fuels which (a) are available from non-petroleum sources as well as from petroleum, (b) are compatible with traditional gasoline and the engines designed to use such gasoline, and (c) which combust efficiently with respect to input energy utilization and have correspondingly low emissions. Although the present invention is described with regard to use in an internal combustion engine, in its broader scope it would include such fuel for use in heating and domestic and industrial uses as well as propulsion fuels, i.e., for jet engines and rocket propellants.

Gasolines, as used today, are "super hydrocarbon" mixtures wherein more than optimum hydrocarbons are presented to the engine resulting in "knock", which is the audible manifestation of too rapid explosion-combustion within the engine. Also, due to this rapid, non-optimal combustion, not all of the hydrocarbons are completely burned, thus not all of the potential energy fed into the engine as gasoline is converted to kinetic energy. This follows an energy balance equation (EBE) as follows: E input = E output plus emissions of incomplete combustion products plus heat. The damage to engine systems at the site of these too rapid explosion-combustions has to be prevented by adding "dampers" or dampening agents, which are "anti-knock" agents. This non-optimal or supra-massive presentation of hydrocarbons to the engine results in incomplete or non-optimal combustion which produces needlessly high levels of hydrocarbon, carbon monoxide and nitrous oxide emissions. Even when unleaded gasoline is used, catalytic converters are required to meet emission control standards in most cars. It follows that by presenting a "leaner" but more optimally arranged hydrocarbon fuel to the engine one can avoid not only most pollutants, which the emissions represent, but also avoid the waste of energy sources which those same pollutants constitute.

The Energy Balance Equation indicates (a) the efficiency and (b) the form of energy conversion that is obtained. Energy can only be converted from one form to another; depending on the type of energy conversion desired in any reaction the aforementioned (a) and (b) become evident.

$$\text{Energy Input} = \text{Energy Output}$$
$$[E^i] = [E^o]$$

Thus the utilization of fuel can be expressed as follows:

$$\text{Fuel input in } [H_nC_n] \times \text{amount} = [\text{Work}^{intensity} \times \text{Work}^{duration}] + \text{Chemical residues} + \text{Heat}$$

This equation may also be stated as follows:

$$\text{Fuel } [F^i] = \text{Horsepower} \times \text{miles/gallon} + \text{exhaust emissions } [HC + CO + NOX] + \text{heat}$$

In the development of new fuels it is important, at least for propulsion-automotive engines, to have maximum work output (e.g. Horsepower × miles/gallon) with minimal residues or heat (e.g. emission exhausts + heat) for the amount of hydrocarbons presented per volume unit (i.e., gallon) to be most efficient. Thus in comparing our new fuel with gasoline as the standard, one finds that our fuel is a more efficient and better fuel in terms of efficiency of conversion, e.g. $[E^i \rightarrow E^o]$ and in terms of better form of conversion, e.g., work output with minimal heat and residues.

The present hydrocarbon mixture acts as a primer to enable the gasoline in the mixture to combust more efficiently with reference to higher energy output and lower emission residues. It is believed these hydrocarbons form an inflammable shell surrounding the gasoline which provides a primer ignition to combust the gasoline within the shell.

Gasoline is a natural high carbon sequence of hydrocarbons, cracked from petroleum. The lower number hydrocarbons and in particular methane, acetylene and dimethyl ketone or acetone are related in the synthesizing sequence for acetylene and acetone from methane. The three carboned acetone can be derived from methane and in the course thereof, passes through the two-carbon stage as acetylene. Acetylene can be readily synthesized from methane. This process of the conversion, $CH_4$ (methane) to $C_2H_2$ (acetylene) to $CH_3$—CO—$CH_3$ (acetone), is part of this invention. In the manufacture one may obtain a mixture of methane, acetylene and acetone. Such mixture may be used in the present invention.

Acetone can hold and absorb methane or acetylene or both on a stable basis. In addition an important aspect of the invention is the ability of acetone to enter into a stable composition with gasoline as well as providing the aforementioned absorption.

In addition to providing the link for a stable composition, acetone also contributes its low flash point and low hydrocarbon number so as to reduce the mass of hydrocarbons presented for combustion without reducing the power capacity of the engine and, apparent from observation, even increasing it, based on field tests, while precluding the need for anti-knock dampers and reducing emissions by presenting a fuel which is much more totally combusted without wasteful hydrocarbon and carbon monoxide emissions and without inducing nitrous oxide emissions by raising temperatures to those usually required for complete gasoline combustion.

The importance of the sequential relationship of the low-numbered hydrocarbons and the inclusion of one of them, acetone, as the stabilizing link with gasoline, or other vehicular fuels, including diesels, was verified by field testing and subsequently by laboratory testing of vehicles operating on the present fuel. The requisite stability essential for use in the context of existing engine technology was found by laboratory testing compositions consisting of gasoline and other vehicular fuels, the low number sequential hydrocarbons related through synthesis with dimethyl ketone as an essential component therein, plus the inclusion of other hydrocarbons readily absorbable in the fuel. Not included are all ketones except dimethyl ketone because—whether primary, secondary, tertiary, or with branched structures—they lack the characteristics which would make them usable with gasoline in this optimal fuel. Substitution of acetone by other ketones results in fuels less optimal than the present invention. This has been verified by laboratory and field testing.

The present liquid fuel may include from 50 to 75 percent dimethyl ketone and from 25 to 50 percent gasoline by weight. The preferred fuel is about 60 percent dimethyl ketone and about 40 percent gasoline. The present liquid fuel may have one or more combustible gaseous materials dissolved therein such as a lower hydrocarbon. Illustrious gaseous materials are the lower alkanes, alkenes, and alkynes, such as methane, ethane, propane, butane, or pentane; ethene, propene, butene, pentene, or hexene; and acetylene. Preferred gaseous materials are methane and acetylene. The liquid fuel may have dissolved in it gaseous fuel from partial to complete saturation.

The amount of dissolved gaseous fuel may depend on the amount of dimethyl ketone present and the particular gaseous materials. For example, methane may be dissolved in an amount up to about 20 volumes of gas per volume of dimethyl ketone present. In the case of acetylene, the gaseous fuel may be present in an amount of up to about 25 volumes of gas per volume of dimethyl ketone. Generally the gaseous fuel may be present in an amount of from about 1 to 16 volumes of gaseous fuel per volume of liquid fuel.

Field testing and vehicle laboratory testing of these fuels was designed for and undertaken to test three basic factors:

(a) determine whether the fuels are directly usable by standard automobiles;

(b) determine whether the fuels' characteristics are closely similar to commercially available gasoline;

(c) determine whether the fuels have the stability to withstand variables in field conditions.

All three determinations have been made in the affirmative.

EXAMPLE I

A test vehicle was selected containing a well-known, well-regarded standard, 6-cylinder 225 CID (cubic inch displacement) Chrysler Corporation engine. This engine continues to be used in 1980 Chrysler Corporation cars, including the Chrysler LeBaron. The car had the additional virtue of having been designed without substantial pollution control equipment which made attribution of emissions from the tested fuels more reliable in the absence of intervening catalytic converters or EGR devices which could themselves favor certain fuels or muffle emission variables.

In the field testing, all parts and machinery in the car were standard. Just as the vehicle has been selected for its simplicity, so too the field testing settled upon two standard components, chemically pure acetone combined with commercial gasoline which was unleaded with no additives.

Initial field tests made using the leaded regular gasoline prescribed for this car failed. Treatment of leaded gasoline to remove all additives to obtain the original raw gasoline state was achieved by repeated solvent washing out of the regular additives in the gasoline using 1 normal HCl acidulated water followed by treatment with activated charcoal columns and ion-exchange resin columns followed by dehydration through a "Drierite" $CaSO_4$ column. This ensured that all organic anti-knock additives, including heavy metals, had been substantially removed leaving raw gasoline. When this raw gasoline thus obtained was used in conjunction with acetone, the performance was very good. Hence as a practical measure all further field tests were conducted using raw gasoline with acetone. The two components, 59 percent acetone and 41 percent gasoline, form the base test fuel.

RATIONALE OF THE INVENTION AND RESULTS

Gasoline is a unique heterogenous mixture of alkane hydrocarbons wherein a large number of carbon and hydrogen units in ascending sequence are provided in the mixture. It is important to note that the combustibility of commercial gasoline, namely its fuel efficiency as measured by flash point using either open cup or closed cup methods, is in the range of minus 45° C. Hence any synthetic heterogenous hydrocarbon mixture, in order to have the combustability and power of combustion of gasoline as used in the automobile industry or other propulsion industry, must necessarily have the features that gasoline has, namely (a) at least an optimal number of hydrocarbons, namely carbon and hydrogen units to provide a replacement of those parts of the gasoline that are substituted, (b) the substituted segments must have flash points comparable to the minus 45° C. range, as gasoline; (c) recognition of the fact that using a low-number hydrocarbon fuel mixture wherein it was important to arrive at an appropriate and carefully designed mixture of the combinant parts of the low-number hydrocarbon derivative bases, e.g., acetone (60% approximately), with the gasoline fraction or gasoline part approximately 40%, in such a ratio that an optimal amount of hydrocarbons was present for combustion, ignitibility and delivery of power to the automobile mechanism and yet obviate the use or addition of anti-knock compounds to dampen or suppress the flammability.

Vehicular modification is limited to replacing all fuel lining-contact areas from neoprene to non-neoprene bases, e.g., teflon, thereby making such lining resistant to the solvent action of acetone. A manual switch was installed so that the car would readily operate either on the base test fuel or gasoline from its regular tank. The car was then driven under a variety of road and weather circumstances and readily switched back and forth between the two fuels. The only noticeable performance difference was that the base test fuel appeared to be more powerful, particularly at higher freeway speeds and during rapid acceleration.

Subsequently, the test car and the base test fuel, together with two 1979 automobiles (a General Motors four-cylinder Chevette and a Chrysler Corporation Plymouth Volare) were tested; the fuel was presented by means of a one-gallon gravity tank leading into the carburetors, via the fuel pump in the case of Volare but only with gravity feed in the case of the Chevette. Those test results were as follows:

1973 Dodge Dart - Regular Gasoline and Base Test Fuel

| Dynamometer | Regular (leaded gasoline) | | Base Test Fuel | | Federal Standard[1] | |
|---|---|---|---|---|---|---|
| Conditions | CO | HC,ppm | CO | HC,ppm | CO | HC,ppm |
| at neutral | 1.6% | 110 | 1.3% | 20 | 2% | 260 |
| at drive | 1.4% | 140 | 1.2% | 30 | 2% | 260 |
| at 1100 rpm | 0.6% | 140 | 1.0% | 60 | 2% | 260 |
| at 2350 rpm | 2.0% | 140 | 0.1% | 20 | 2% | 260 |
| at 35 mph cruise | 0.4% | 160 | not tested | | 2% | 260 |
| horsepower | 53 | | 58 | | 55 factory rated | |

[1]These are federal minimum performance standards for cars on the road; the standard for HC is lower for the older car. The Standards are included for comparison purposes.

1979 Chrysler Corp. Volare and General Motors Chevette Base Test Fuel

| Dynamometer | 1979 Plymouth Volare, 6 cylinder | | 1979 Chevette 4 cylinder | | Standard[1] | |
|---|---|---|---|---|---|---|
| Conditions | CO | HC, ppm | CO | HC, ppm | CO | HC, ppm |
| at neutral | 0.2% | 100 | no CO | 80 | 2% | 200 |
| at drive | 0.1% | 100 | no CO | 70 | 2% | 200 |
| at 1100 rpm | no CO | no HC | no CO | 50 | 2% | 200 |
| at 1950 rpm | no CO | no HC | not tested | | 2% | 200 |
| at 3100 rpm | not tested | | no CO | no HC | 2% | 200 |
| horsepower | 64 | | | | 54 factory rated | |
| horsepower | | | 28 | | 25 factory rated | |

[1]These are federal minimum performance standards for cars on the road; the standard for HC is lower for the older car. The Standards are included for comparison purposes.

To further verify the performance of the base test fuel, particularly when compared with gasoline, the 1973 Dodge Dart had been subjected to the standard EPA and Highway tests administered by a Federal Environmental Protection Agency approved testing laboratory. The results were as follows:

| | Base Test Fuel | | | Federal new car standards | |
|---|---|---|---|---|---|
| | FTP[2], 1st run | FTP, 2nd run | Indolene 30[3] FTP 1 | 1973 | 1979 |
| HC grams/mile | 1.61 | 1.56 | 4.96 | 3.4 | 1.5 |
| CO grams/mile | 35.2 | 32.4 | 139.3 | 39.0 | 15.0 |
| NOX grams/mile | 1.69 | 1.59 | 1.07 | 3.0 | 2.0 |

[2]"FTP" means the standard federal testing procedure for city driving utilized for EPA testing.
[3]Standard testing gasoline used for vehicles designed for regular leaded gasoline.

| | Base Test Fuel | | | | Indolene 30 | |
|---|---|---|---|---|---|---|
| | FTP 1st run | HW[4] 1st run | FTP 2nd run | HW 2nd run | FTP | HW |
| Fuel Economy (mpg) | 13.4 | 18.6 | 13.4 | 18.8 | 14.4 | 20.3 |
| 55/45 ratio FTP/HW mpg average | 15.4 | | 15.4 | | 16.5 | |

The field and laboratory testing data clearly shows:

(a) Equal or better horsepower compared with gasoline;
(b) Remarkably lower emission exhaust products such as CO, HC, NOX, which are the chemical residues of combustion; and
(c) Equal or nearly equal miles per gallon compared with gasoline.

[4]"HW" is the highway fuel economy equivalent. See Federal Register Vol. 44, No. 58, March 23, 1979, at page 17946; 40 CPR Part 610.

Use of the Energy Balance Equation illustrates the efficiency of this invention.

Fuel [F$^i$] = Horsepower × miles/gallon + exhaust emissions [HC + CO + NOX] + heat Comparing the invention with gasoline, it is plain that the invention provides transportation with approximately the same miles per gallon with greater horsepower, lower exhaust emissions, and lower operating temperatures. In other words, the present fuel has a higher conversion number on the Energy Balance Equation. This shows that the present fuel is in fact a more efficient and more optimal fuel than commercially available gasoline. Although the present fuel has been described with regard to use in automobiles it is to be recognized that it will have wider application. For example, the present fuel may be used in heating, domestic and industrial propulsion, rocket propellant mixes or wherever hydrocarbon fuels resembling gasoline are used.

What is claimed is:

1. A liquid fuel for automotive use, said fuel comprising dimethyl ketone and gasoline, wherein said dimethyl ketone is present in an amount of about 59 percent and said gasoline is present in an amount of about 41 percent.

2. A liquid fuel for automotive use, said fuel comprising from 50 to 75 percent dimethyl ketone and from 25 to 50 percent gasoline, said gasoline being substantially free of tetraethyl lead, said liquid fuel further including dissolved combustible gaseous fuel.

3. The fuel of claim 2 wherein said gaseous fuel is one or more members of the group consisting of alkanes, alkenes, and alkynes.

4. The fuel of claim 2 wherein said liquid fuel is saturated with said dissolved gaseous fuel.

5. The fuel of claim 2 wherein said dissolved gaseous fuel is a member selected from the group consisting of methane and acetylene.

6. A liquid fuel for use in internal combustion engines, said liquid fuel consisting essentially of by weight from 50 to 75 parts dimethyl ketone, from 25 to 50 parts gasoline and from 1 to 16 volumes dissolved gaseous fuel, said gaseous fuel being at least one member selected from the group consisting of methane and acetylene.

7. A liquid fuel for use in internal combustion engines, said liquid fuel including gasoline and dimethyl ketone, said gasoline being present in an amount of from about 25 to 40 percent and said dimethyl ketone being present in an amount of from about 60 to 75 percent by weight.

8. A liquid fuel for use in internal combustion engines, said liquid fuel including gasoline and dimethyl ketone, said dimethyl ketone being present in an amount of at least 50 percent by weight, said gasoline being present in an amount of at least 25 percent by weight, said fuel having from 1 to 16 volumes of dissolved combustible gas.

9. The fuel of claim 8 wherein said combustible gas is methane and acetylene.

10. The fuel of claim 8 wherein said fuel includes dissolved methane and wherein said methane is dissolved in an amount of up to 20 volumes of gas per volume of dimethyl ketone.

11. The fuel of claim 8 wherein said fuel includes dissolved acetylene and wherein said acetylene is dissolved in an amount of up to about 25 volumes of gas per volume of dimethyl ketone.

12. A hydrocarbon fuel consisting essentially of 50 to 75 parts petroleum fuel by weight and a member selected from the group consisting of 1 to 25 volumes acetylene and 1 to 20 volumes methane, wherein said petroleum fuel has been washed with acidulated water, treated in an activated charcoal column and an ion-exchange column and then dehydrated in a calcium sulfate column.

* * * * *